US005228675A

United States Patent [19]

Didier

[11] Patent Number: 5,228,675

[45] Date of Patent: Jul. 20, 1993

[54] SHEET SEPARATION PILE FEEDER

[75] Inventor: Carl J. Didier, Piqua, Ohio

[73] Assignee: Baumfolder Corporation, Sidney, Ohio

[21] Appl. No.: 826,609

[22] Filed: Jan. 28, 1992

[51] Int. Cl.[5] ..... B65H 3/48

[52] U.S. Cl. ..... 271/105; 271/104; 271/121

[58] Field of Search ..... 271/97, 98, 105, 121, 271/133, 167, 104

[56] References Cited

U.S. PATENT DOCUMENTS

| | | | |
|---|---|---|---|
| 177,174 | 5/1876 | Tolles . | |
| 196,016 | 10/1977 | Hoffman . | |
| 1,449,377 | 3/1923 | Broadmeyer | 271/105 |
| 2,374,578 | 4/1945 | Bernard et al. | 271/105 |
| 3,083,011 | 3/1963 | Saul | 271/105 |
| 3,199,863 | 8/1965 | Muller | 271/207 |
| 3,547,431 | 12/1970 | Wagner | 271/11 |
| 3,907,280 | 9/1975 | Bendall et al. | 271/174 |
| 3,977,670 | 8/1976 | Tsuruta et al. | 271/207 |
| 5,088,717 | 2/1992 | Hamanaka et al. | 271/98 |
| 5,090,676 | 2/1992 | Matsuno et al. | 271/98 |
| 5,092,578 | 3/1992 | Bergmeier et al. | 271/97 |
| 5,110,110 | 5/1992 | Wirz et al. | 271/98 |

FOREIGN PATENT DOCUMENTS

| | | | |
|---|---|---|---|
| 448081 | 9/1991 | European Pat. Off. | 271/98 |
| 545351 | 2/1932 | Fed. Rep. of Germany | 271/104 |
| 1090687 | 10/1960 | Fed. Rep. of Germany | 271/98 |
| 460823 | 12/1913 | France | 271/108 |
| 27845 | 2/1986 | Japan | 271/105 |
| 43135 | 2/1990 | Japan | 271/98 |
| 2060576 | 5/1981 | United Kingdom | 271/98 |

*Primary Examiner*—Robert P. Olszewski
*Assistant Examiner*—Steven M. Reiss
*Attorney, Agent, or Firm*—Millen, White, Zelano & Branigan

[57] ABSTRACT

A sheet separation pile feeder (34) includes a sheet separation enhancer comprising first and second tubular blow members (42, 42'), each having a plurality of specially-arranged blow holes (44, 44' 44*a*, 44'*a*) therein, extending across a leading side (22) of a pile from which forward-most sheets (18) are fed. Each tubular blow member is rotatably mounted so that it can rotate about its axis relative to the pile and a pressure means pressurizes interiors of the tubular blow members for creating streams of fluid (52, 52') coming from the blow holes directed toward the leading side of the pile. Thus, each of the tubular blow members can be rotated to adjust directions at which the streams of fluid from the holes contact the leading side of the pile to enhance feeding of the forward-most sheet thereof being fed from the pile. The first and second blow tubes are parallel to one another and to the sheets in the pile. The second tubular blow member is positioned below the first tubular blow member in planes approximately parallel to the leading side of the pile. Each of the first and second rotatable tubular blow members has an outer regulator tube (56, 56') linearly slidably mounted thereon with regulator holes (58, 58' 58*a*, 58'*a*) therein corresponding to the blow holes for selectively covering and uncovering them with sliding movement of the regulator tubes. Indicia (64, 64', 60, 60') on the tubular blow member and its regulator tube indicate which blow holes are uncovered.

22 Claims, 3 Drawing Sheets

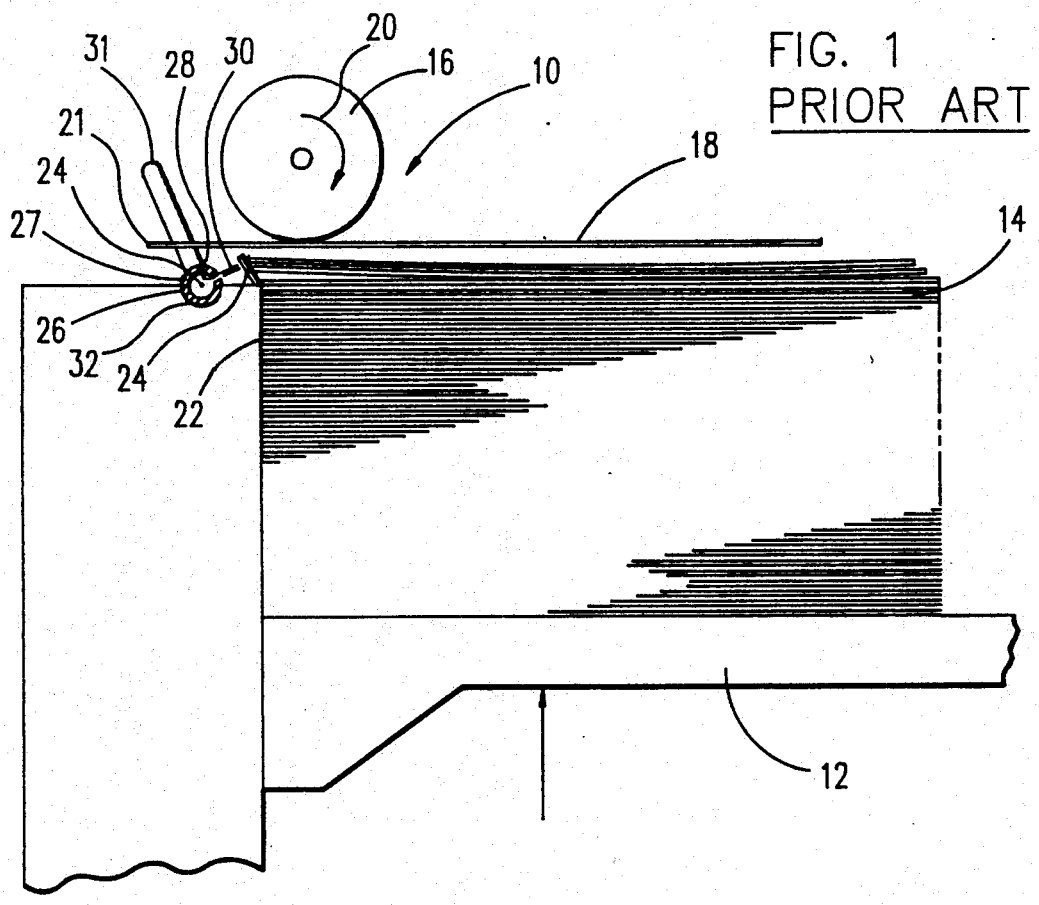
FIG. 1
PRIOR ART
FIG. 4A
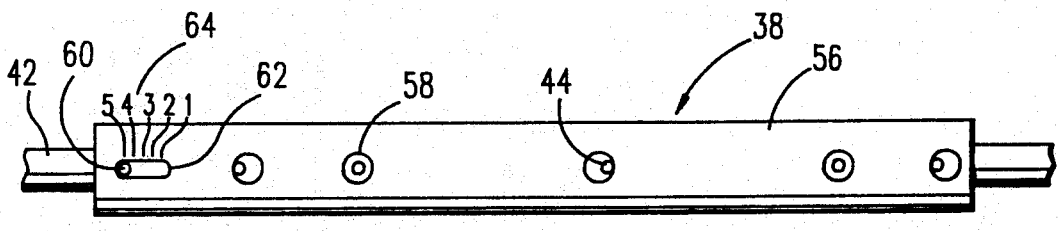
FIG. 4B
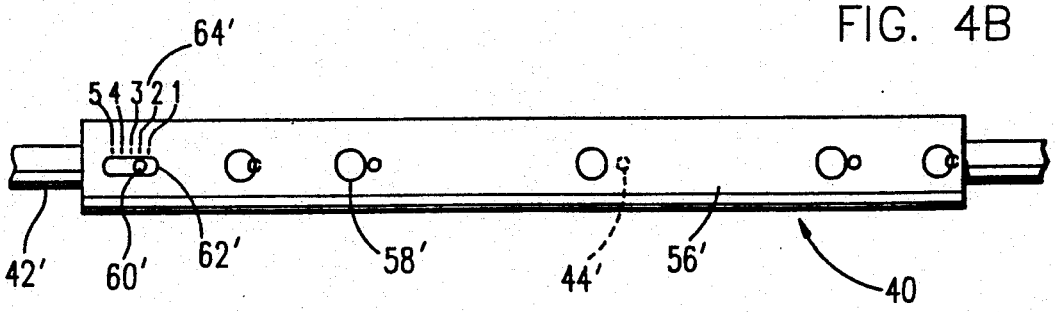

SHEET SEPARATION PILE FEEDER

BACKGROUND OF THE INVENTION

This invention relates broadly to the art of sheet feeders for sequentially feeding forward-most sheets from sheet piles and more particularly to separation enhancers for enhancing separation of forward-most sheets from such piles when they are being fed therefrom.

Sheet feeders for feeding forward-most sheets from sheet piles have long been utilized in graphic art industries as well as in other industries. A pneumatic separation enhancer for such sheet feeders has also been used in which a blow tube having blow holes therein extends across a leading side of a pile for directing streams of air from the blow holes at leading edges of top-most sheets in the sheet pile for creating cushions of air between the sheets and helping to separate a leading edge of a forward-most sheet from the rest of the pile so that it can be more easily gripped or can otherwise avoid false feeds from the pile. In one case, such a tubular blow member has been rotatable so that directions of streams of air coming from the blow holes can be changed and in one case the tubular blow member has had clips thereon at each blow hole which can be rotated about the tubular blow member to partially obstruct the blow holes and thereby also change the direction of fluid streams flowing therefrom. By properly adjusting such a tubular blow member, and its clips, an operator can direct fluid from the blow holes toward a forward edge of a forward-most sheet, particularly at its forward corners, helping to lift the sheet from the pile as well as at leading edges of other sheets immediately below the forward-most sheet for creating thin cushions of air therebetween and thereby helping to separate these sheets from one another. Although this single tubular blow member has proven to be quite beneficial, helping to prevent false feeds, it has several disadvantages. A prime disadvantage of this system is that these many different adjustments take a relatively long time to make. Similarly, such adjustments are necessarily made by trial and error, which makes them inexact, time-consuming and difficult. Along the same line, the clips are difficult to reach when the tubular blow member is mounted on a sheet separation pile feeder, with movable parts being in the same vicinity. Thus, great care and difficulty is required to make the necessary adjustments. Yet another difficulty with the above-described arrangement of a tubular blow member sheet separator is that an undue number of false feeds are obtained therewith. In this regard, such a tubular blow member extending across a leading side of a sheet pile from which forward-most sheets are fed is often not sufficient for both properly lifting corners of the sheets and creating sufficient cushions of air between sheets below the forward-most sheet. Thus, in many cases, such tubular blow members are combined with other tubular blow members positioned along the sides of sheet piles blowing on side edges of sheets in the pile.

For all of these reasons, it is an object of this invention to provide a tubular blow member sheet separation enhancer for a sheet separation pile feeder extending across a front, or leading, side of a sheet pile from which sheets are fed which efficiently enhances the feeding of forward-most sheets from the pile, is relatively easy and convenient to adjust, is not unduly complicated in structure, and can be relatively easily manufactured and installed for use under various conditions.

SUMMARY OF THE INVENTION

According to principles of this invention, a sheet separation enhancer comprises first and second tubular blow members extending across a leading side of a sheet pile from which sheets are fed, each being rotatable about its axis for directing streams of air from its blow holes toward a different area of the leading side so that streams of fluid from one of the tubular blow members can be more concentrated near a leading edge of a forward-most sheet and streams of fluid from the other tubular blow member can be more concentrated on leading edges of sheets positioned adjacent the forward-most sheet.

In a preferred embodiment, the first and second tubular blow members are not rotationally linked so that they can be rotated independently of one another. The first and second tubular blow members are approximately parallel to one another and to the sheets in the pile and the first tubular blow member is positioned above the second tubular blow member. Each of the tubular blow members has an outer regulator tube slidably mounted thereon with a guide for interengaging the regulator tube with its tubular blow member for allowing linear motion of the regulator tubes to uncover selected ones of the blow holes. An indicia indicates the position of each regulator tube relative to its tubular blow member and thereby indicates which blow holes are uncovered, and to what extent. Arrangements of blow holes and regulator holes are different for the first and second tubular blow members and their regulator tubes.

BRIEF DESCRIPTION OF THE DRAWINGS

The foregoing and other objects, features and advantages of the invention will be apparent from the following more particular description of a preferred embodiment of the invention, as illustrated in the accompanying drawings in which reference characters refer to the same parts throughout the different views. The drawings are not necessarily to scale, emphasis instead being placed upon illustrating principles of the invention in a clear manner.

FIG. 1 is a schematic, partially sectional, side view of a prior art sheet separation pile feeder employing a single sheet-separation-enhancer tubular blow assembly;

FIG. 4A is a front plane view of a simplified embodiment of a tubular blow member of this invention when an outer regulator tube thereof is in a first position designated as 5;

FIG. 4B is a similar view of the same tubular blow member as in FIG. 4A with an outer regulator tube being in a position designated as position 2; and, FIG. 5 is an enlarged, more detailed, front plane view of a preferred embodiment of first and second tubular blow members with regulator tubes thereof respectively being in positions 2 and 3.

DETAILED DESCRIPTION OF THE PREFERRED EMBODIMENTS

Figure 2:
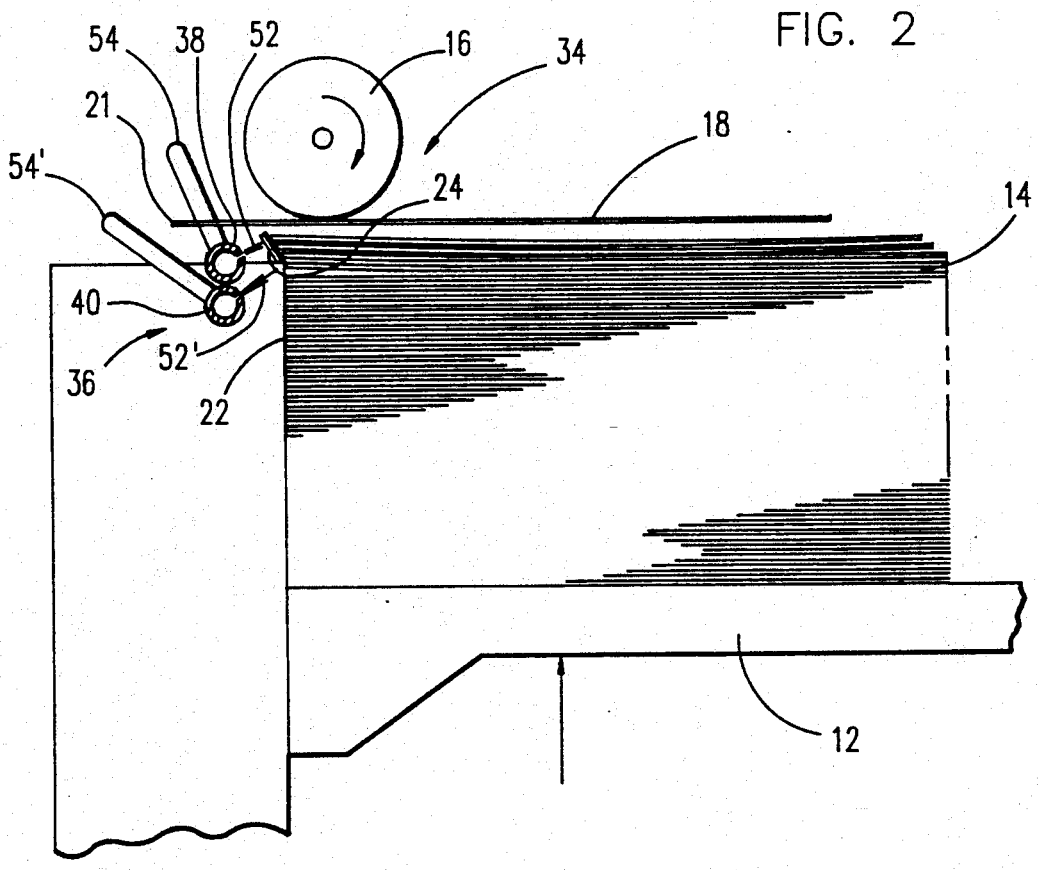
FIG. 2 is a view similar to FIG. 1 but depicts a sheet separation pile feeder of this invention having a sheet separation-enhancer of this invention, with portions removed for clarity.

Looking first at the prior art depicted in FIG. 1, a sheet-separation pile feeder 10 has a sheet pile holder 12 which is biased upwardly to urge a sheet pile 14 against a sheet-feeding device, in this case, a sheet-feeding roller 16. The sheet-feeding roller 16 engages a forward-most (which is the top-most in the depicted embodiment) sheet 18 of the pile 14 and rotates as indicated by arrow 20 to urge a leading edge 21 of the forward-most sheet 18 laterally from a leading side 22 of the sheet pile 14 past a stop, or other holding device, 24 which engages leading edges of sheets positioned immediately adjacent the forward-most sheet 18 and prevents them from being fed with the forward-most sheet 18. Because there is a great deal of friction between the sheets of the sheet pile 14, and because in some cases the sheets are actually stuck together, it is sometimes difficult for the sheet-feeding roller 16 to separate the forward-most sheet 18 from the rest of the pile. For this reason, a sheet separation enhancer in the form of a tubular blow assembly 26 is provided. The tubular blow assembly 26 comprises a tubular blow device or tube, 27 having a plurality of spaced blow holes 28 therein through which streams 30 of pressurized fluid, such as air, are directed at leading edges of forward-most sheets in the sheet pile 14. The radial directions of these streams 30 of fluid can be determined by rotating the tubular blow device about its axis 29 by means of a handle 31. The tubular blow assembly 26 also includes a plurality of director clips 32, one mounted on the tubular blow member 27 at each of the blow holes 28 to be rotated thereat so as to cover the blow hole and direct the stream 30 of pressurized fluid in a more tangential direction relative to the tubular blow member 27. Thus, some of the clips can be adjusted to direct their respective streams 30 toward the leading edge 21 of the forward-most sheet 18 while others can be directed toward sheets immediately below the forward-most sheet 18 to begin separation thereof by creating cushions of air therebetween. As previously mentioned, adjustments with such a mechanism are rather difficult because there are so many members to adjust and because access to the members is not convenient. Further, trial and error is required which is time-consuming. Also, such a single tubular blow assembly 26 can not be adjusted to be sufficiently effective and often side blow assemblies are also required.

Figure 3:
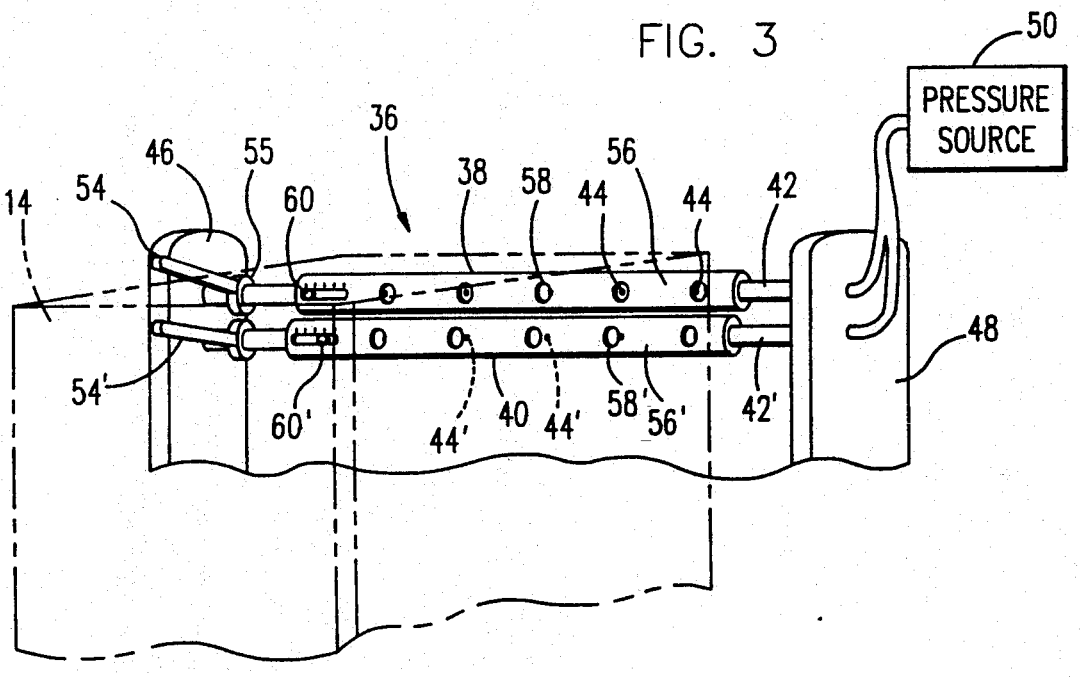
FIG. 3 is an isometric view of a sheet separation enhancer comprising simplified tubular blow member assemblies of this invention with a sheet pile shown in phantom.
Figure 5:
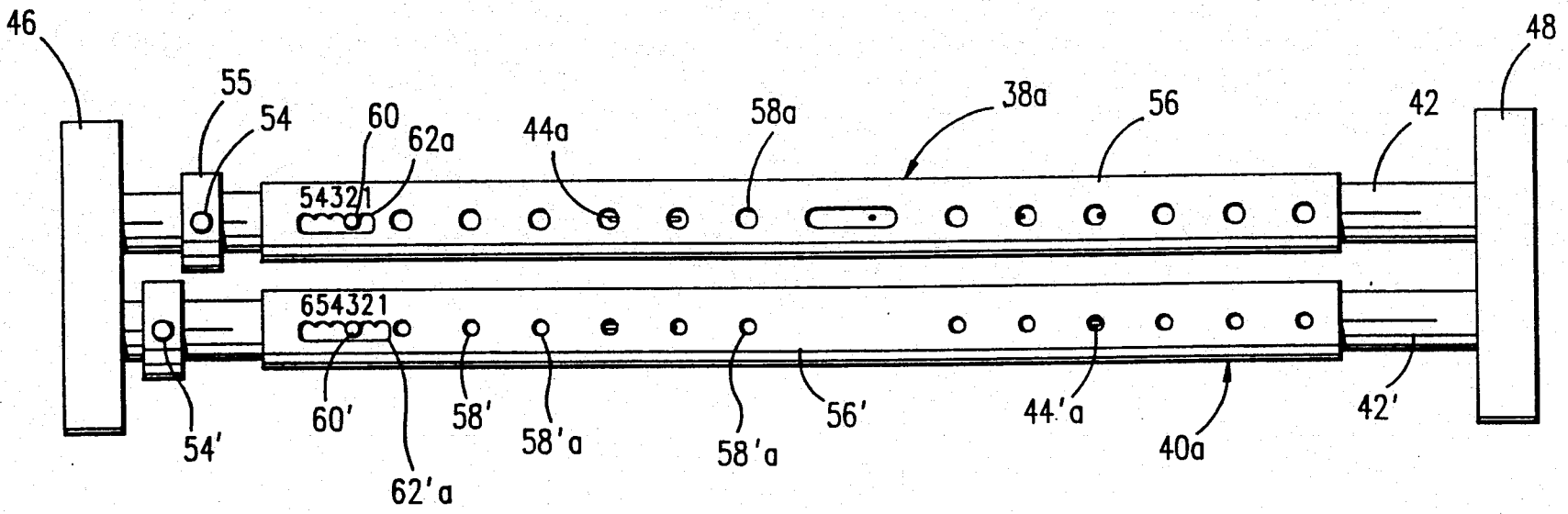

Looking now at a simplified sheet-separation pile feeder 34 of this invention, shown in FIGS. 2–4, this assembly also comprises a sheet pile holder 12 for biasing a sheet pile 14 toward a sheet-feeding roller 16 which engages a forward-most sheet 18 of the sheet pile 14 when it rotates to feed a leading edge 21 of the forward-most sheet 18 laterally away from a leading side 22 of the sheet pile 14 while sheets adjacent to the forward-most sheet 18 are prevented from being fed by a holding device 24. In this invention, a sheet separation enhancer 36 comprises first and second blow assemblies 38 and 40. The first and second tubular blow assemblies 38 and 40 are substantially identical, however, in a preferred embodiment, see FIG. 5, their blow hole configurations are quite different. The first and second tubular blow assemblies 38 and 40 are shown in more detail in FIGS. 3, 4A and 4B. Each of these assemblies comprises a tubular blow member 42 having a line of blow holes 44 therein. The elements of the second tubular blow assembly 40 are designated by primed reference numerals because quite often, as shown in FIG. 5, the arrangement of the blow holes in the second tubular blow assembly 40 is different from that of the first tubular blow assembly 38. Each of the tubular blow members 42 and 42' is rotatable about its axis within supports 46 and 48 and interiors of the tubular blow members 42 and 42' are coupled to a pressure source 50 so as to receive a positive pressure therefrom. Thus, when the sheet separation enhancer 36 is in operation, streams 52 and 52' of fluid (air) come from the blow holes 44 and 44'. The directions in which the blow holes 44 and 44' direct the streams 52 and 52' of fluid are partly determined by positions of handle levers 54 and 54' which are clamped by collars 55 to outside surfaces of the first and second tubular blow members 42 and 42'. In this respect, the handle levers 54 and 54' are shown oriented differently in FIGS. 2 and 3 for purposes of illustration, but normally these handles would be directed generally adjacent the sheet pile 14.

In order to provide further adjustments of the streams 52 and 52' of fluid flowing from the tubular blow members 42 and 42', first and second outer regulator tubes 56 and 56' are respectively slidably mounted on outer surfaces of the tubular blow members 42 and 42' so that they can be linearly slid therealong to cover and uncover the blow holes 44 and 44'. In this respect, the outer regulator tubes 56 and 56' have regulator holes 58 and 58' therein which correspond to positions of the blow holes 44 and 44' in such a manner that when the regulator tubes 56 and 56' are slid along their respective tubular blow members 42 and 42' some of them line up with blow holes 44 and 44' and some do not. A locating-and-guiding pin 60 or 60' is affixed to each of the tubular blow members 42 or 42' to extend through a guiding slot 62 or 62' of its respective regulator tube 56 or 56' so as to allow limited linear movement of its respective outer regulator tube 56 or 56' and to thereby assure that regulator holes 58 or 58' remain aligned with blow holes 44 or 44'. Indicia 64 or 64' on each of the outer regulator tubes 56 or 56' indicates which of the blow holes 44 or 44' are uncovered, with the locating-and-guiding pin 60 or 60' serving as an indicator therewith. In this regard, the indicia 64 or 64' is positioned so as to be visible to an operator who moves the respective outer regulator tube for adjustment.

In a preferred embodiment of this invention, as is depicted in FIG. 5 in more detail, the blow hole **44'*a* arrangement of a second tubular blow assembly 40*a* is quite different from the blow hole 44*a* arrangement of the first tubular blow assembly 38, as is the arrangement of the regulator holes 58'*a* different from the arrangement of the regulator holes 58*a*. It should be noted that in this preferred embodiment some of the blow holes and regulator holes are also oblong to create desired blow patterns. Also, in this preferred embodiment guiding slots 62*a* and 62'*a* have notches at respective positions to aid in holding the respective guiding pins 60 and 60'** thereat.

One major benefit of this invention is that by having first and second tubular blow assemblies 38 and 40 which extend across a leading side at the leading edges of sheets in a pile streams of fluid can be more easily dedicated to the leading edge of a forward-most sheet and to leading edges of sheets adjacent to the forward-most sheet than was previously possible. That is, the tubular blow members 42 and 42' can be rotated to direct their blow holes 44 and 44' at quite different angles. Similarly, with this invention it is helpful that blow-hole and regulator-hole patterns can be different for the first and second tubular blow assemblies so that blow patterns can be further customized. Since the tubular blow members 42 and 42' can be rotated independently of one another, they can be adjusted for achieving a high reliability of sheet feeding.

It is also advantageous that by having the first and second tubular blow assemblies 38 and 40 at the leading side 22 of the sheet pile 14, arranged in planes approximately parallel to the sheets in the pile and to one another, adjustments for both these members are similar and therefore simplified. Also, adjustment handles can be simultaneously, and easily accessed in the same manner.

Further, and similarly, the outer regulator tubes 56, which extend beyond side edges of the pile 14, can be easily seen and accessed for providing adjustment to flow from the blow holes of the tubular blow members 42 and 42'.

The embodiments of the invention in which an exclusive property or privilege are claimed is defined as follows:

1. A sheet separation pile feeder of a type for feeding forward-most sheets from a sheet pile comprising:

a sheet-pile holder for holding a pile of sheets with a forward-most sheet thereof being fed therefrom;

a sheet feeding device adjacent said forward-most sheet for engaging said forward-most sheet and feeding a leading edge of said sheet laterally away from a leading side of said pile;

a sheet separation enhancer comprising first and second tubular blow members each having a plurality of blow holes therein, each of said tubular blow members extending across said leading side of said pile and each of said tubular blow members being independently rotatably mounted so that it can rotate relative to said pile;

pressure means for pressurizing interiors of said first and second tubular blow members for creating streams of fluid coming from said blow holes directed toward said leading side of said pile to enter between adjacent said sheets of said pile at leading edges of said sheets for cushioning adjacent said sheet against one another and to thereby enhance separation of said sheets and enhance the feeding of the forward-most sheet from said pile;

whereby each of said tubular blow members can be rotated independently of one another to adjust the directions at which said streams of fluid from said holes contact the leading side of said pile at leading edges of said sheets in said pile so as to enter between adjacent said sheets of said pile and cushion adjacent said sheets against one another so as to enhance separation of said forward-most sheet from said pile.

2. A sheet separation pile feeder as in claim 1, wherein blow-hole patterns for the first and second tubular blow members are different.

3. A sheet separation pile feeder as in claim 1, wherein said first and second tubular blow members are positioned approximately parallel to the sheets in the pile.

4. A sheet separation pile feeder as in claim 3, wherein said first and second tubular blow members are positioned adjacent one another approximately in planes parallel to the leading side of said sheet pile.

5. A sheet separation pile feeder as in claim 4, wherein is further included a regulator tube slidably mounted on an outer surface of at least one of said first and second tubular blow members to be slid therealong, said outer regulator tube having regulation holes therein corresponding to blow holes for selectively covering and uncovering blow holes with sliding movement of said regulator tube.

6. A sheet separation pile feeder as in claim 5, wherein is further included a guide means for interengaging said regulator tube with its respective tubular blow member for only allowing linear movement of said regulator tube along said tubular blow member.

7. A sheet separation pile feeder as in claim 6, wherein is further included indicia on said regulator tube and said tubular blow member to indicate the linear position of said regulator tube along said tubular blow member.

8. A sheet separation pile feeder as in claim 5, wherein each of said first and second tubular blow member has a regulator tube mounted thereon.

9. A sheet separation pile feeder as in claim 1, wherein said first and second tubular blow members are positioned approximately parallel to the sheets in the pile.

10. A sheet separation pile feeder as in claim 9, wherein said first and second tubular blow members are positioned adjacent one another in planes approximately parallel to the leading side of said sheet pile.

11. A sheet separation pile feeder as in claim 10, wherein is further included a regulator tube slidably mounted on ah outer surface of at least one of said first and second tubular blow members to be slid therealong, said outer regulator tube having regulation holes therein corresponding to blow holes for selectively covering and uncovering blow holes with sliding movement of said regulator tube.

12. A sheet separation pile feeder as in claim 11, wherein is further included a guide means for interengaging said regulator tube with its respective tubular blow member for only allowing linear movement of said regulator tube along said tubular blow member.

13. A sheet separation pile feeder as in claim 9, wherein blow-hole or regulator-hole patterns for the first and second tubular blow members are different from one another.

14. A sheet separation pile feeder as in claim 1, wherein said first and second tubular blow members are positioned adjacent one another in planes approximately parallel to the leading side of said sheet pile.

15. A sheet separation pile feeder as in claim 14, wherein is further included a regulator tube slidably mounted on an outer surface of at least one of said first and second tubular blow members to be slid therealong, said outer regulator tube having regulation holes therein corresponding to blow holes for selectively covering and uncovering said blow holes with sliding movement of said regulator tube.

16. A sheet separation pile feeder as in claim 15, wherein is further included a guide means for interengaging said regulator tube with its respective tubular blow member for only allowing linear movement of said regulator tube along said tubular blow member.

17. A sheet separation pile feeder as in claim 1, wherein is further included a regulator tube slidably mounted on an outer surface of at least one of said first and second tubular blow members to be slid therealong, said outer regulator tube having regulation holes therein corresponding to blow holes for selectively covering and uncovering blow holes with sliding movement of said regulator tube.

18. A sheet separation pile feeder as in claim 17, wherein is further included a guide means for interengaging said regulator tube with its respective tubular blow member for only allowing linear movement of said regulator tube along said tubular blow member.

19. A sheet separation pile feeder of a type for feeding forward-most sheets laterally from a sheet pile comprising:

a sheet pile holder for holding a pile of sheets with a forward-most sheet thereof being fed therefrom;

a sheet feeding device adjacent said forward-most sheet for engaging said forward-most sheet and feeding a leading edge thereof laterally away from a leading side of said pile;

a sheet separation enhancer at least one a tubular blow member having a plurality of blow holes therein, said tubular blow member extending across said leading side of said pile and being rotatably mounted so that it can rotate relative to said pile;

a pressure means for pressurizing the interior of said tubular blow member for creating streams of fluid coming from said blow holes directed toward said leading side of said pile to thereby enhance separation of said sheets and enhance the feeding of the forward-most sheet from said pile;

wherein is further included an outer regulator tube slidably mounted on said tubular blow member to be slid therealong, said outer regulator tube having regulator holes therein corresponding to blow holes for selectively covering and uncovering said blow holes with sliding movement of said regulator tube.

20. A sheet separation pile feeder as in claim 19, said at least one tubular blow member comprising a first and second tubular blow member, wherein blow-hole or regulator-hole patterns for the first and second tubular blow members are different from one another.

21. A sheet separation pile feeder as in claim 19, wherein is further included a guide means for interconnecting said regulator tube with said tubular blow member for only allowing linear motion of the regulator tube along the tubular blow member.

22. A sheet separation pile feeder as in claim 21 wherein is further included an indicia on one of said regulator tube and said tubular blow member for indicating the relative position of the regulator tube on said tubular blow member.

* * * * *